US007071807B1

(12) United States Patent
Herbert

(10) Patent No.: US 7,071,807 B1
(45) Date of Patent: Jul. 4, 2006

(54) LAMINATED WINDINGS FOR MATRIX TRANSFORMERS AND TERMINATIONS THEREFOR

(76) Inventor: Edward Herbert, 1 Dyer Cemetery Rd, Canton, CT (US) 06019-2029

( * ) Notice: Subject to any disclaimer, the term of this patent is extended or adjusted under 35 U.S.C. 154(b) by 166 days.

(21) Appl. No.: 10/708,843

(22) Filed: Mar. 26, 2004

Related U.S. Application Data

(60) Provisional application No. 60/460,332, filed on Apr. 3, 2003.

(51) Int. Cl.
*H01F 27/24* (2006.01)
*H01F 5/00* (2006.01)

(52) U.S. Cl. ..... 336/234; 336/232; 336/200

(58) Field of Classification Search ..... 336/200, 336/213, 234, 223, 232
See application file for complete search history.

(56) References Cited

U.S. PATENT DOCUMENTS 1,852,805 A * 4/1932 Frank ..... 336/223
3,223,955 A * 12/1965 Olsen et al. ..... 336/211
4,893,400 A * 1/1990 Chenoweth ..... 29/606
5,274,904 A * 1/1994 Proise ..... 29/602.1
5,543,674 A * 8/1996 Koehler ..... 310/164
5,804,902 A * 9/1998 Hill ..... 310/179
5,831,331 A * 11/1998 Lee ..... 257/659
6,000,128 A * 12/1999 Umeno et al. ..... 29/846
6,087,922 A * 7/2000 Smith ..... 336/223
6,583,707 B1 * 6/2003 Ngo et al. ..... 336/234

* cited by examiner

*Primary Examiner*—Anh Mai

(57) ABSTRACT

Laminated primary winding for matrix transformers may be assembled from stacked layers of metal foil or stampings having ends of the metal foil or stampings extended successively to make stepped contact areas having as large a contact area as necessary for the application. In some embodiments the stepped contact areas are on ends of the laminated primary winding that extend beyond the matrix transformer. In other embodiments, the stepped contact areas are on complementary mating subassemblies within the transformer.

8 Claims, 6 Drawing Sheets

LAMINATED WINDINGS FOR MATRIX TRANSFORMERS AND TERMINATIONS THEREFOR

CROSS REFERENCE TO RELATED APPLICATIONS

This is a continuation in part of a provisional application of the same name, Ser. No. 60/460,332 filed 3 Apr., 2003. Priority to that date is claimed.

BACKGROUND OF INVENTION

This invention relates to matrix transformers, and in particular to matrix transformers having multiple turn primaries, either single coil windings as for a full bridge, half bridge or forward converter or multiple coil windings as for push-pull windings, split windings or a forward converter having a reset winding.

FIG. 1 shows a prior art magnetic core 1 as may be used to make a matrix transformer. FIG. 2 shows a phantom view 4 of the magnetic core 1 of FIG. 1 further comprising first and second secondary windings 2 and 3. FIG. 3 shows a prior are "element" 5 of a matrix transformer comprising a pair of magnetic cores 1, 1 which are the magnetic core 1 of FIG. 1 each further comprising first and second secondary windings 2 and 3. The secondary windings 2 and 3 may be connected in various arrangements as required by a particular application.

FIG. 4 shows a prior art matrix transformer 10 comprising five magnetic elements 5—5 which are the magnetic element 5 of FIG. 3. A primary winding 11 is wound by hand through the five elements 5—5 of the matrix transformer 10. Winding the primary winding 11 is a labor intensive manual operation. It is time consuming and requires considerable skill, yet the result is often messy. If the wires of the primary winding 11 cross in the matrix transformer 10, it can be difficult or impossible to get the required number of turns, and their arrangement is somewhat random yielding inconsistent product.

FIG. 5 shows a prior art printed circuit winding 15 for a matrix transformer, and FIG. 6 shows the printed circuit winding 15 installed in a matrix transformer 20. A plurality of terminal pins 21—21 connect the printed circuit winding to a mother board, both to complete the turns around the end of the matrix transformer 20 and for connection to external circuitry. This arrangement has several problems. On is that the vias in the printed circuit winding occupy space that restricts the conductor area of conductors that must pass the vias. Another is the current crowding that occurs at the via. Also, usually a number of the turns of the primary winding just wrap around the transformer, not requiring any termination, yet every turn of the printed circuit winding 15 is connected through the mother board.

SUMMARY OF INVENTION

This invention teaches that a laminated primary winding may be fabricated with stepped exposed surfaces of the several layers of the laminated primary winding, each having an arbitrarily large contact area for rugged, high current terminations. Windings that do not need to be terminated externally can be connected directly side to side. In some embodiments of the invention, the stepped exposed surfaces are on one end of the transformer. In other embodiments, the stepped exposed surfaces are mated to and soldered to complementary stepped exposed surfaces of a mating laminated winding within the transformer.

BRIEF DESCRIPTION OF DRAWINGS

FIG. 20 is a finished matrix transformer using the laminated primary winding of FIG. 12.

DETAILED DESCRIPTION

Figure 1:
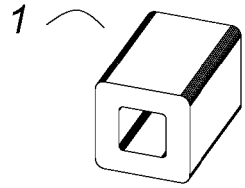
Fig. 1 Prior Art
FIG. 1 shows a prior art magnetic core.
Figure 2:
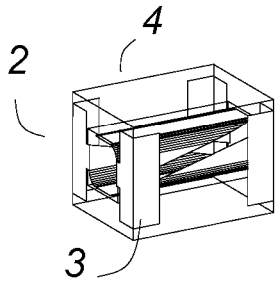
Fig. 2 Prior Art
FIG. 2 shows the core of FIG. 1 in phantom and shows two prior art secondary windings installed therein.
Figure 3:
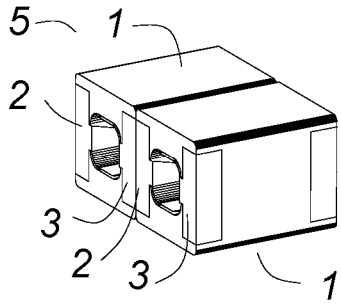
Fig. 3 Prior Art
FIG. 3 shows a prior art matrix transformer "element".

FIG. 1 shows a prior art magnetic core 1 as may be used to make a matrix transformer. Note in particular that the magnetic core 1 does not have a gap, it is one solid piece. Because of that, the core is not assembled around a winding as in a conventional transformer. The winding has to be inserted through the center hole of hte magnetic core 1. FIG. 2 shows the magnetic core 1 of FIG. 1 as a phantom core 4, with prior art first and second secondary windings 2 and 3. FIG. 3 shows a prior are "element" 5 of a matrix transformer comprising a pair of magnetic cores 1, 1 which are the magnetic core 1 of FIG. 1 each further comprising first and second secondary windings 2 and 3. The secondary windings 2 and 3 may be connected in various arrangements as required by a particular application. As examples, not limitations, they may be connected in series for higher voltage or as a "half turn" winding for lower voltage, higher current applications.

Figure 4:
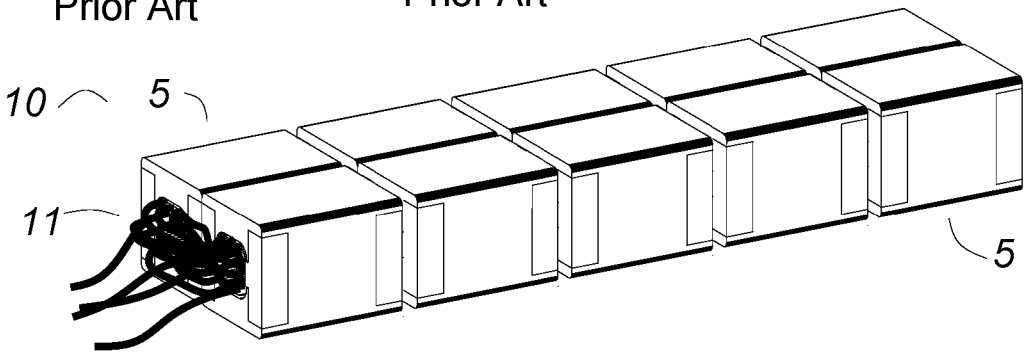
Fig. 4 Prior Art
FIG. 4 shows a prior art matrix transformer with a wound primary winding.

FIG. 4 shows a prior art matrix transformer 10 comprising five magnetic elements 5—5 that are the magnetic element 5 of FIG. 3. Because the magnetic cores of the elements 5—5 are solid one piece cores, the winding must be inserted through the center holes of the elements 5—5. A primary winding 11 is wound by hand through the five elements 5—5 of the matrix transformer 10. Winding the primary winding 11 is a labor intensive manual operation. It is time consuming and requires considerable skill, yet the result is often messy. If the wires of the primary winding 11 cross inside of the matrix transformer 10, it can be difficult or impossible to get the required number of turns, and their arrangement is somewhat random yielding inconsistent product.

Figure 5:
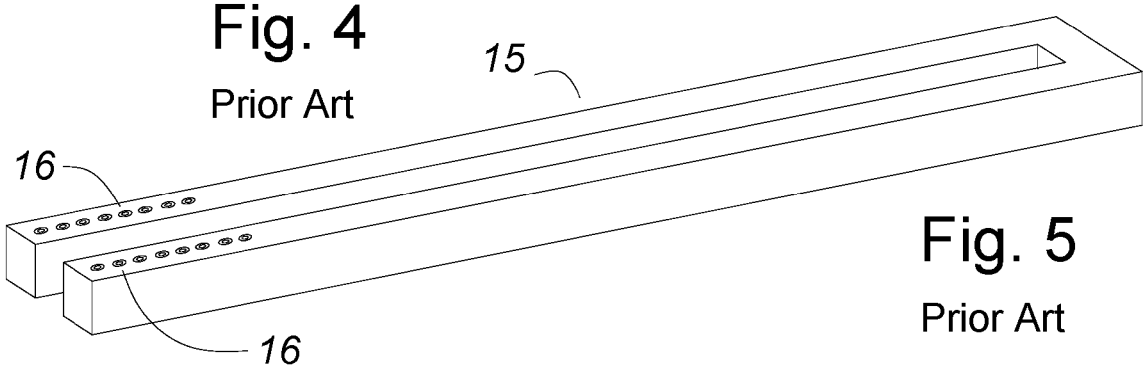
Fig. 5 Prior Art
FIG. 5 shows a prior art printed circuit primary winding for a matrix transformer.
Figure 6:
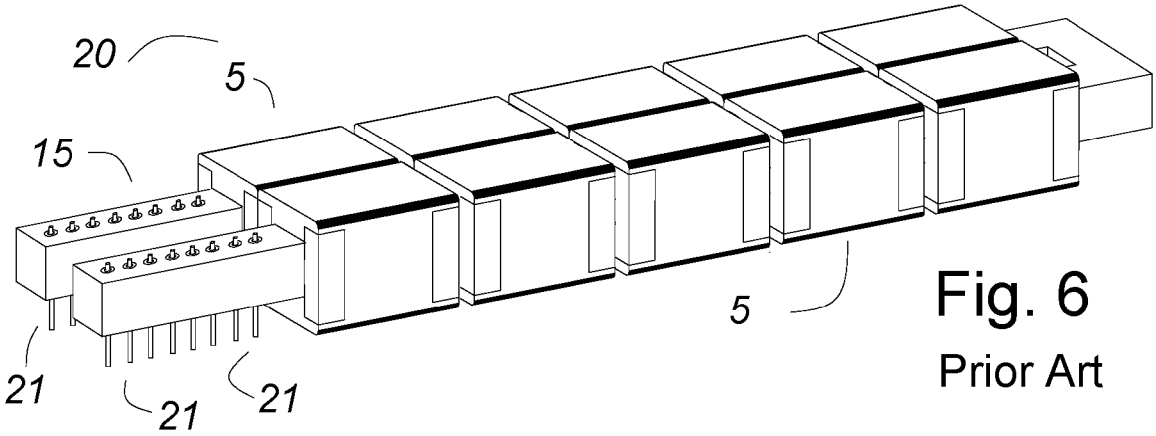
Fig. 6 Prior Art
FIG. 6 shows a prior art matrix transformer with a prior art printed circuit primary winding.

FIG. 5 shows a prior art printed circuit winding 15 for a matrix transformer, and FIG. 6 shows the printed circuit winding 15 installed in a matrix transformer 20. The printed circuit winding is made in a "U" shape, open at one end, with slender legs suitable for inserting through center holes in solid magnetic cores. To complete coils for a transformer primary winding, the windings in a printed circuit winding such as the printed circuit winding 15 must be completed by external connection from side to side a the open end after it is assembled into a matrix transformer. A plurality of terminal pins 21—21 may connect in vias 16—16 in the printed circuit winding 15 to a mother board. This arrangement has several problems. On is that the vias 16—16 in the printed circuit winding 15 occupy space that restricts the conductor area of conductors that must pass the vias 16—16. Another is the current crowding that occurs at the vias 16—16 where they interface with the several layers within the printed circuit winding 15. Also, usually a number of the turns of the primary winding just wrap around the transformer, not requiring any termination, yet every turn of the printed circuit winding 15 is connected through the mother board.

Figure 7:
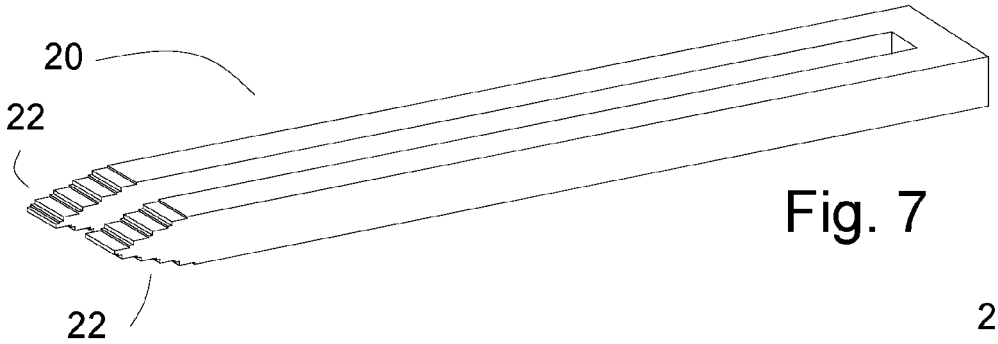
FIG. 7 shows a laminated primary winding of this invention for a matrix transformer.

FIG. 7 shows a laminated primary winding 20 for a matrix transformer having stepped terminations 22. The stepped terminations 22 are the extended ends of a plurality of "U" shaped sheet metal windings within the laminated primary winding 20, successively stepped so each of the sheet metal winding has a generous exposed electrical contact areas as terminations for making interconnections within the transformer and for making electrical connections to circuitry that is external to the matrix transformer. "U" shaped sheet insulation between the sheet metal winding layers keeps the winding layers separated and electrically isolated, and the insulation is preferably extended somewhat to ensure electrical separation and discourage bridging of solder. The insulation may be separate pieces, or it may be a film or coating on the sheet metal windings.

Figure 8:
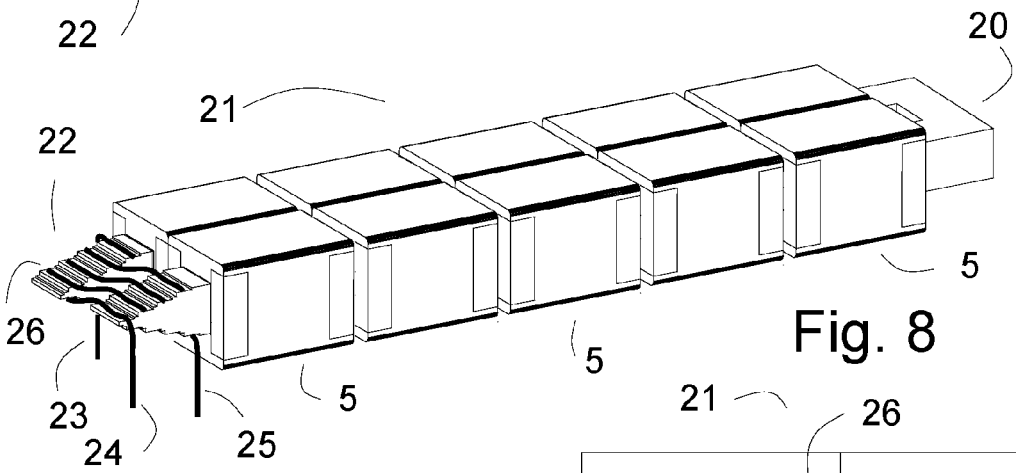
FIG. 8 shows the laminated primary winding of FIG. 7 installed in a matrix transformer.
Figure 10:
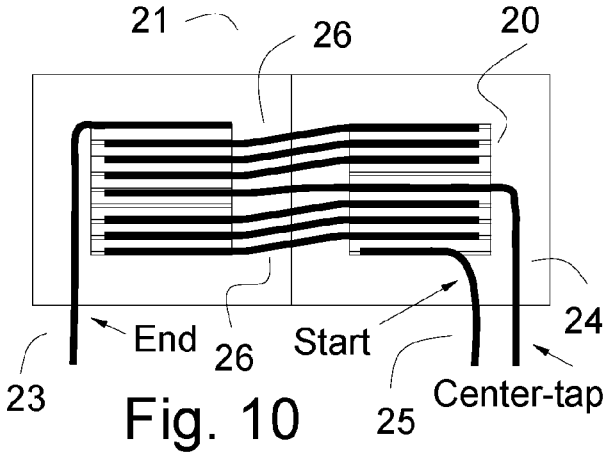
Figure 11:
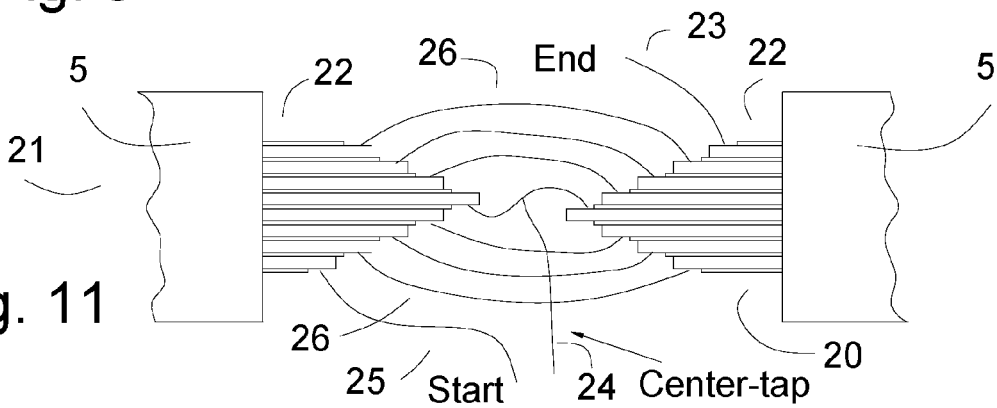

FIG. 8 shows the laminated primary winding 20 installed in a matrix transformer 21. The stepped terminations 22 may be connected in a variety of ways for different applications. In FIG. 8 the laminated primary winding 20 is connected as a push pull winding as an example, not a limitation. FIGS. 10 and 11 show the push pull connection in more detail. A start termination 25 comprises a copper wire connection which extends downward sufficiently to be a through hole termination for a printed mother board. Similarly, an end termination 23 comprises a copper wire connection which extends downward sufficiently to be a through hole termination for a printed mother board. A center-tap connection 24 comprises a copper wire connection that connects the laminated winding 20 from one side of the laminated winding 20 to the other and then continues extending downward sufficiently to be a through hole termination for a printed mother board. A plurality of side to side jumper wires 26—26 connect those turns of the laminated primary winding 20 that do not connect to the external circuitry. The through hole configuration is an example, not a limitation, as obviously they could be configured in many ways, wire leads, surface mount pads, screw terminals, slip fit terminals, and so forth as would be well known to one skilled in the art. Also, the center-tap termination 24 could alternatively be terminated with two separate wires so as to make a split winding primary, or the center-tap could be simple another side to side jumper 26 to make a single coil primary winding.

Figure 9:
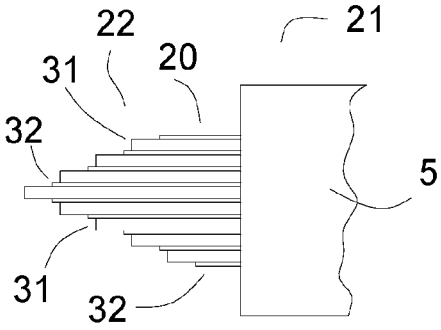
FIGS. 9, 10 and 11 show the terminations for the laminated primary winding of FIGS. 7 and 8 in more detail.

FIG. 9 shows the stepped terminations 22 of the laminated primary winding 20 of the transformer 21 in more detail. It can be seen that a plurality of copper foil windings 31—31 are separated by layers of insulation 32—32. Although not shown, the outside surface of the laminated primary winding 20 is preferably coated or wrapped with insulation before inserting it into the elements 5—5 of the transformer 21.

Note in FIG. 9 that each layer of insulation 32—32 extends slightly beyond the copper foil windings 31—31 so as to define a termination area that has sufficient exposed copper surface to make a rugged connection yet is separated from layer to layer to prevent solder bridging or short circuits. Although solder connections are recited, that is as an example, not a limitation, as it would be possible to fashion a mechanical connector with contacts to perform a similar termination function or to connect and interconnect the stepped terminations 22 in a variety of ways, as would be well known to one skilled in the art of electrical assembly.

The laminated primary winding 20 could be made using usual printed wiring board techniques by etching the "U" shaped windings, stacking and bonding multiple layers, then cutting away the excess material as by routing. Alternatively, "U" shaped stampings could be stacked with pre-preg "U" shaped insulation to make a finished assembly in one pressing and molding operation. However, a preferred alternative method of making the laminated winding 20 is to assemble large strips of copper into long laminated assemblies of copper stacked with insulation with the edges extended in steps to become the future termination areas. This can be a continuous process using rolls of copper stock and insulation stock. After lamination and curing of the adhesives, the bars can be cut into short sections and can be machined into "U" shapes. The cutting and machining will likely smear the edges, causing layer to layer short circuits, but these short circuits can be removed easily with a simple etching process to etch back the copper so as to be flush or slightly below flush with respect to the insulation on the sides of the laminated windings. A dip coat or wrap of insulation then completes the assembly. The exposed copper termination areas may be tin plated, and this is preferred if the laminated winding may be stored for a period of time. However this would not be necessary if they were fluxed and soldered soon after fabrication.

Figure 12:
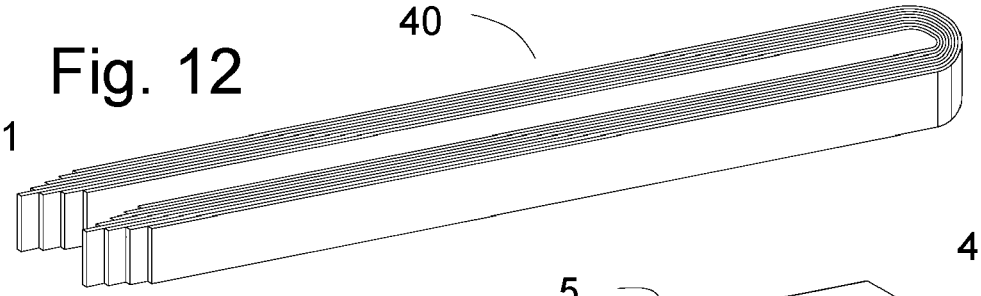
FIG. 12 shows a laminated primary winding of this invention for a matrix transformer.

FIG. 12 shows a laminated primary winding 40 in which the laminated layers are oriented vertically (in contrast to the horizontal orientation of the laminated primary winding 20 of FIG. 7). It is similar to the laminated winding 20 of FIG. 7 in having stepped terminations 41. To distinguish the laminated primary winding 20 of FIG. 7 from the laminated primary winding 40 of FIG. 12, the laminated primary winding 20 of FIG. 7 has "flat stacked "U" shaped windings" whereas the laminated primary winding 40 of FIG. 12 has "nested "U" shaped windings".

Figure 13:
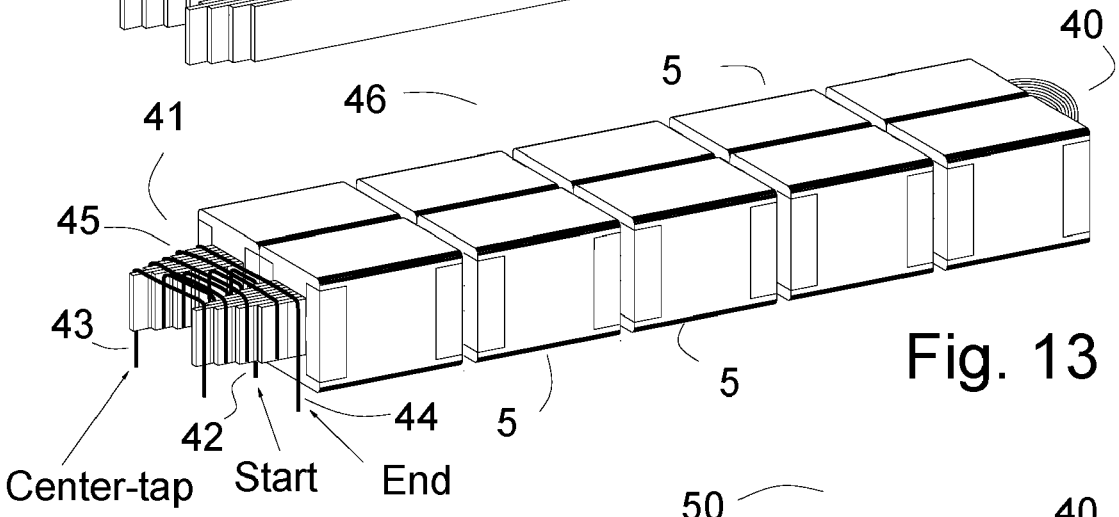
FIG. 13 shows the laminated primary winding of FIG. 12 installed in a matrix transformer.

The laminated primary winding 40 of FIG. 12 may be fabricated of copper strip of uniform width (the height of the laminated primary winding 40), formed in successive "U" shapes, nested and bonded with interleaved insulating layers. The result may have a stepped termination 41 which is similar in design to the stepped termination 22 of FIG. 9 except for its vertical orientation. However, a preferred alternative method of fabrication would have long sheets of copper folded into nesting "U" shaped sheets with interleaved insulation sheets bonded together into long "U" shaped assemblies, perhaps as a continuous process using rolled stock. The strips can then be cut across to make the laminated primary windings 40 with no waste except the saw cut. Likely the cutting process would cause some copper smearing from layer to layer, and any resulting short circuits can be removed by back etching. A final dip or wrap of insulation would insulate the edges, FIG. 13 shows the laminated primary winding 40 installed in a matrix transformer 46 comprising five elements 5—5, as an illustration, not a limitation. The stepped termination areas 41 are wired with "U" shaped wires to connect and terminate the primary windings, as shown in more detail in FIG. 14. A "U" shaped start winding 42 is in the center. Although it is "U" shaped, and touches both ends of the laminated primary winding, it connects only to one side as indicated comprising the start of the winding. On the other side, it may contact an area of the stepped termination area 41 that is insulated, or it may have an insulating coating or sleeve. Regardless, it can be put in place and will be self-fixturing until it is soldered. Similarly, a "U" shaped end winding 44 bridges both ends of the laminated primary winding 40, but it connects with just one side as indicated comprising an end connection.

Figure 14:
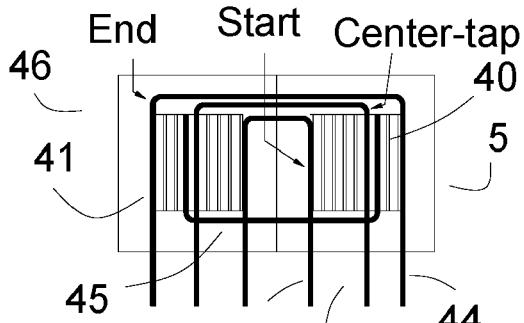
FIG. 14 shows the terminations for the laminated primary winding of FIGS. 12 and 13 in more detail.

A center-tap termination 43 is also "U" shaped, but contacts termination areas on both sides of the laminated primary winding to make both a side to side connection and also a connection for connecting the matrix transformer 46 to a mother board or other circuitry. A plurality of "U" shaped jumpers connect the other windings from side to side as necessary to complete the transformer coils. The connections shown in FIGS. 13 and 14 are for a push pull primary winding, as an illustration, not a limitation. Other winding arrangements such as split coils or a single coil can be easily accommodated by modifying the interconnections and terminations, as would be well understood by one skilled in the art of transformers.

Figure 15:
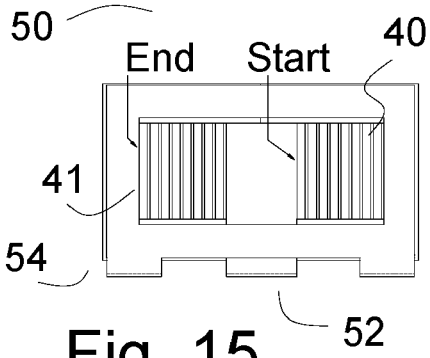
FIGS. 15 through 20 show alternative terminations for the laminated primary winding of FIG. 12.
Figure 16:
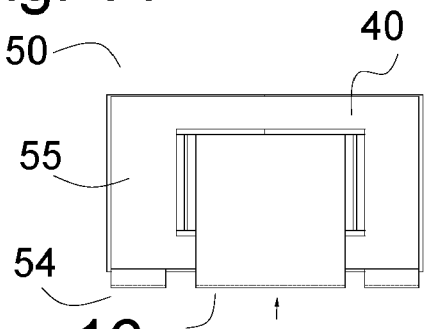
Figure 17:
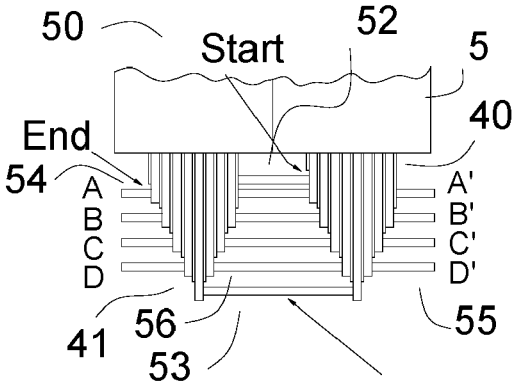
Figure 18:
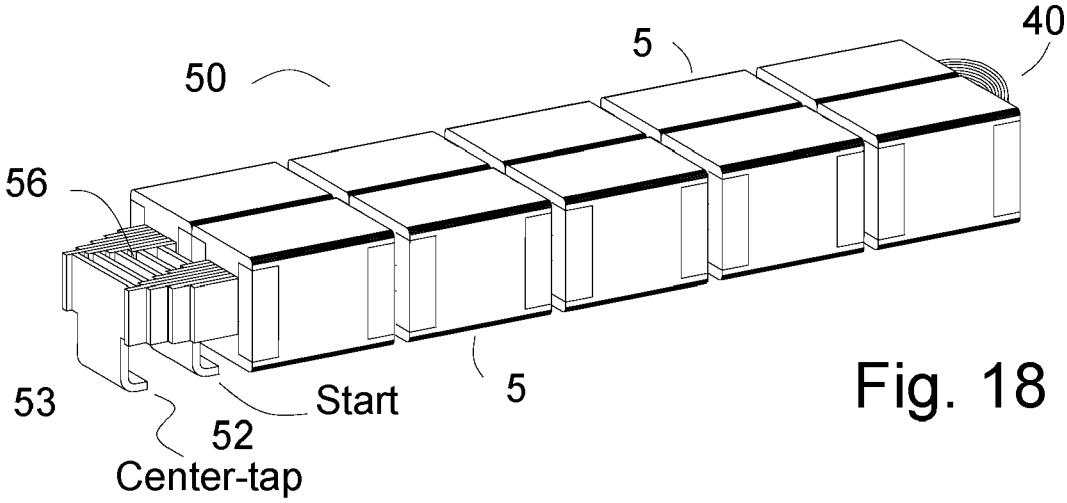
Figure 19:
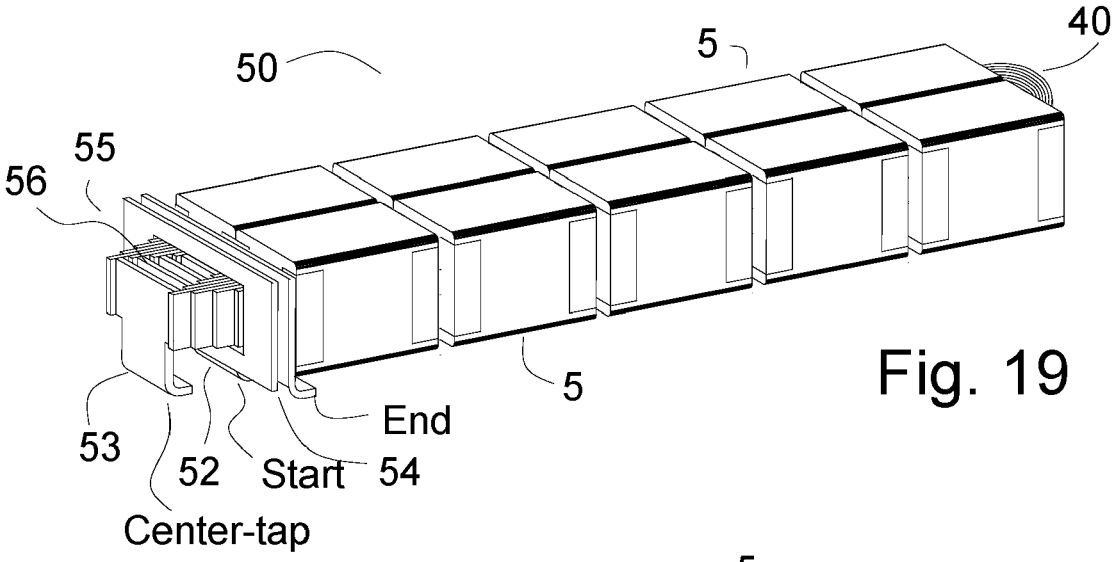
Figure 20:
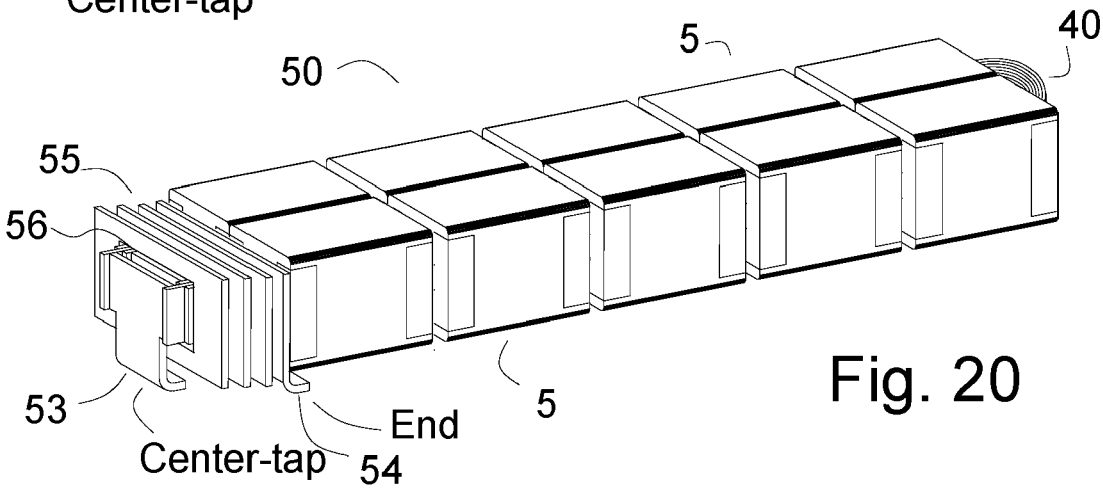

FIGS. 15 through 20 show a matrix transformer 50 using the same laminated primary winding 40 but having much more substantial stamped metal terminations and interconnections. FIGS. 16, 17 (a section view) and 20 show the completed matrix transformer 50, while the other figures show partly assembled terminations, for clarity. A push pull primary winding connection is shown as an illustration, not a limitation.

FIG. 15 shows that a start termination 52 and an end termination 54 is installed. The start winding 52 bridges between the sides of the laminated primary winding 40, but as with the start termination 42 of FIGS. 13 and 14, it is connected on just one side, as indicated, and is insulated on the other. Because it is wedged between the ends of the laminated primary winding, it is self-fixturing until it is soldered. With reference to the section view shown in FIG. 17, the right side of the start winding 52 is connected as indicated, and the left side is insulated from the conductors of the winding 40.

Similarly, the end termination 54 comprises a stamping that frames the winding 40. The end termination 54 is connected on just the end side as indicated (the A side in FIG. 17), and is insulated from the laminated primary winding 40 o the other side (the .A' side) However, by using a structure that surrounds the whole structure, it is self-fixturing until it is soldered.

Next a plurality of side to side connections 55 and 56 are installed. Additional external side to side connections 55 and internal side to side connections 56 are used to complete the winding connections that do not connect to external circuitry. Lastly, an internal side to side connection comprising a center-tap termination 53 is installed. The start 52, the end 54 and the center-tap 53 are shown with surface mount feet as an example not a limitation. It is contemplated that the windings may be assembled with solder paste in place and that the whole maybe be reflowed after assembly. However it could be soldered manually with each operation. The connection and termination stampings could also connect by friction, or they could be assembled into a connector like assembly that slips onto the stepped ends 41 of the laminated winding 40.

Figure 21:
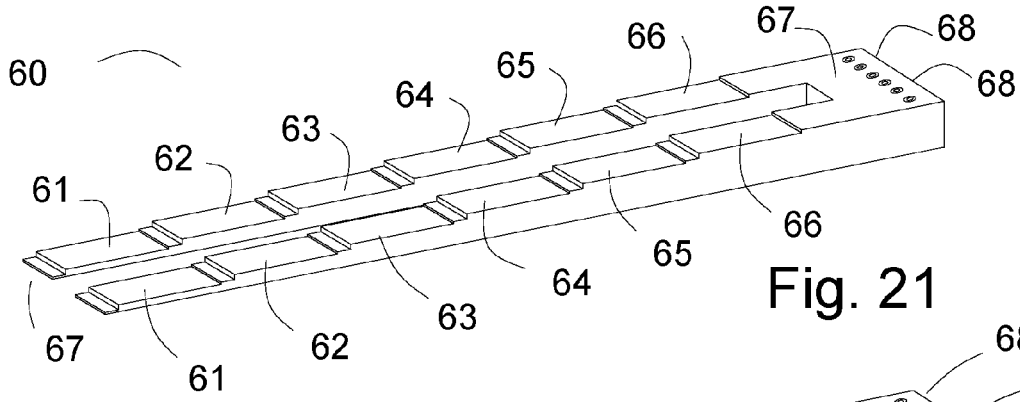
FIG. 21 shows one of a pair of mating laminated primary windings having stepped exposed complimentary mating contact areas.
Figure 22:
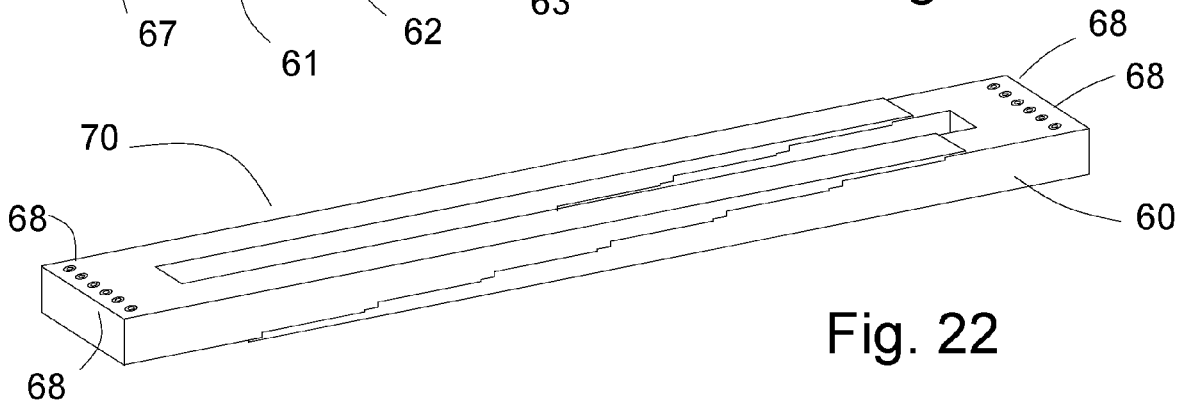
FIG. 22 shows a pair of mated laminated primary windings.
Figure 23:
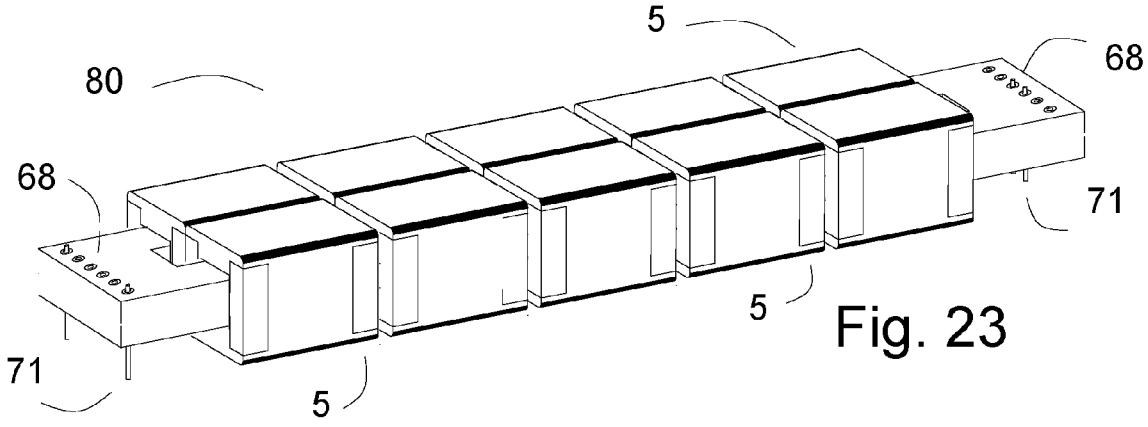
FIG. 23 shows the mated laminated primary winding installed in a matrix transformer and terminated with pins.

FIGS. 21 through 23 show a matrix transformer 80 having five elements 5—5 (as an illustration, not a limitation) and a laminated primary winding 70. The laminated primary winding 70 comprises mating first and second laminated sub-assemblies 61 and 69 having complementary stepped connection areas.

FIG. 21 shows the first laminated sub-assembly 61. It comprises six "U" shaped copper stampings 61 through 66 stacked with stepped exposed surface termination areas, and with insulation 67—67 between the layers and on the outside surfaces. FIG. 22 shows that a similar second laminated sub-assembly 69 may be mated with and soldered to the first laminated sub-assembly 61 to comprise the laminated primary winding 70. Vias 68—68 may connect the several layers of the laminated primary winding 70 and, as shown in FIG. 23, may receive terminating pins 71—71 for connection to external circuitry. As contrasted with the vias 16—16 of FIG. 5, the vias 68—68 are beyond the main winding area of the laminated primary winding 70 so they do not crowd the conduction path. Further, only those vias that connect to external circuitry need to have terminating pins 71—71.

As an alternative to the vias 68—68, the various layers of the laminated primary winding 70 could have tabs extending from the layers that are to be connected externally.

It is contemplated that the stepped termination areas of the first and second laminated sub-assemblies 61 and 69 would be tinned generously or coated with solder paste, then they would be assembled into the matrix transformer 80 with a clamping means (not shown) urging them into close contact. The clamping means could be a springy member or some elastic material, or it could be clamping fingers reaching between the elements 5—5 to clamp them together. Regardless of how they are held together, it is contemplated that the matrix transformer 80 would be heated to cause the solder to reflow.

Figure 24:
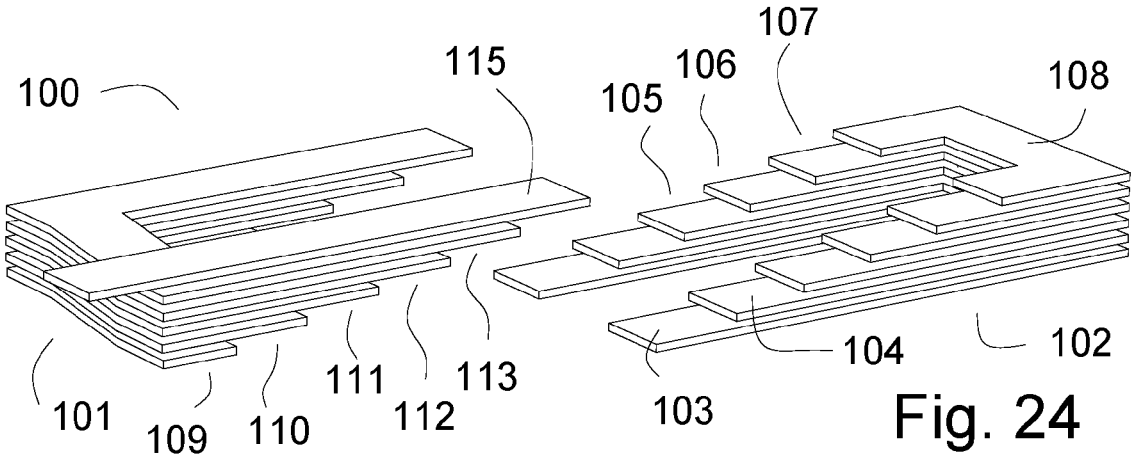
FIG. 24 shows complementary stacks of metal foil windings (with the insulation not shown, for clarity) for use in a matrix transformer.
Figure 25:
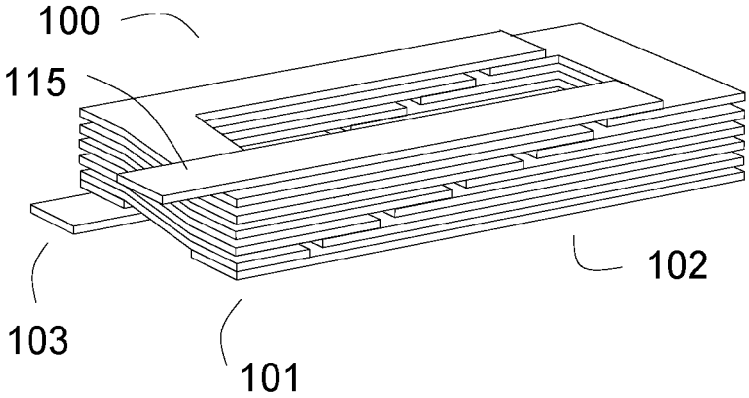
FIG. 25 shows the same complimentary stacks of metal foil windings placed together in their installed positions.

FIGS. 24 and 25 show in more detail how complementary stacks of metal stampings 103 through 115 maybe arranged to make a laminated primary winding 100 comprising first and second laminated sub-assemblies 101 and 102. FIGS. 24 and 25 are shown in exaggerated scale, spread apart and without the insulation so that the resulting winding can be traced to better understand the interconnections. Note that the stamped windings 103 and 115 are extended so as to provide self-terminations for the laminated primary winding 100.

Figure 26:
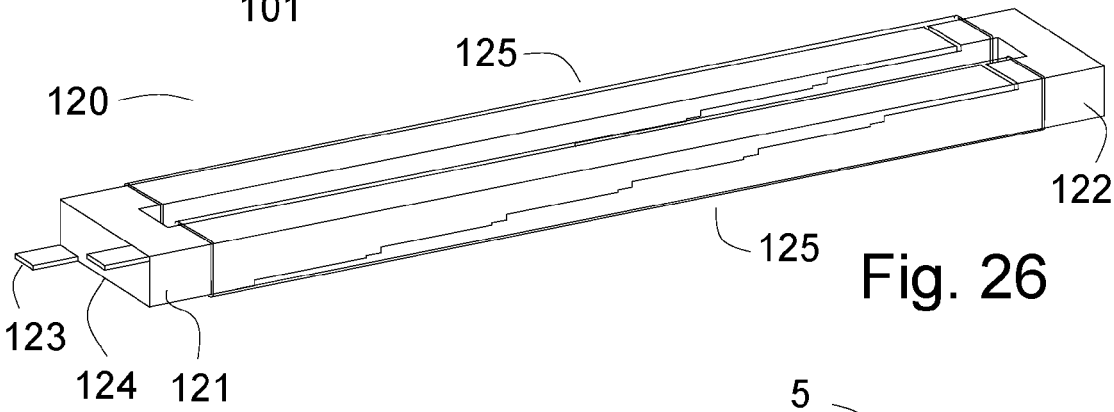
FIG. 26 shows that a winding similar to the winding of FIGS. 24 and 25 can be molded into complementary assemblies.

FIG. 26 shows a laminated primary winding 120 comprising first and second laminated sub-assemblies 121 and 122. The internal construction and interconnection maybe as shown in FIGS. 24 and 25, and extensions of two or more of the internal layers may comprise self-terminations 123 and 124. Insulating sleeves 125, 125 may be used over the laminated primary winding 120 to provide greater dielectric isolation. It is to be understood that the laminated primary winding 120 and its insulating sleeve would not be assembled outside of a matrix transformer, and FIG. 26 shows them assembled only to illustrate certain details that are hidden in the final assembly. The insulating sleeves 125—125 should fit closely to the laminated primary winding, and it may have shrink sleeve properties which could be useful in urging the first and second laminated sub-assemblies 121 and 122 together for reflow soldering. For illustration only, not as a limitation, the insulating sleeves are shown as being transparent so that the stepped connection between the first and second laminated sub-assemblies 121 and 122 can be seen.

Figure 27:
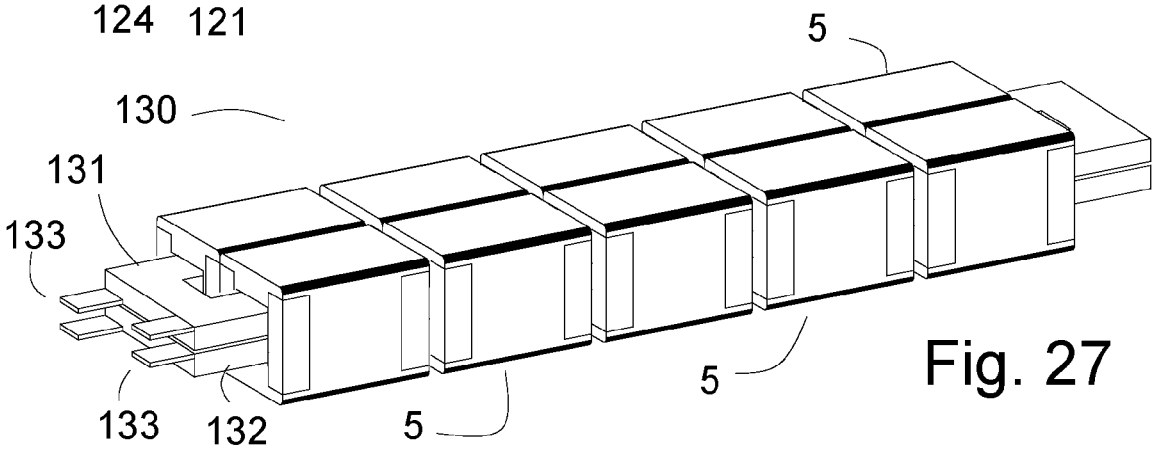
FIG. 27 shows two molded laminated primary winding assemblies installed in a matrix transformer as a push pull primary winding.

FIG. 27 shows a matrix transformer 130 having five elements 5—5 (as an illustration, not a limitation) and two laminated primary windings 131 and 132 The laminated primary windings 131 and 132 have self terminations 133—133, and could be connected either as a push pull winding, in series, in parallel or as a split winding. It is contemplated that each of the laminated primary windings may be similar to the winding 120 of FIG. 26. It is also contemplated that an expansion means (not shown) may be used between the laminated primary windings 131 and 132 to urge them apart and to provide a clamping force when they are assembled and reflow soldered. Also, by urging them apart and into good contact with the secondary windings of the matrix transformer 130, heat sinking is improved. The expansion means might be a springy or elastic member inserted between the laminated primary windings 131 and 132.

FIGS. 21 through 27 show subassemblies made of flat stacked "U" shaped windings, but equivalent subassemblies can be made with nested "U" shaped windings, and their function would be the same.

Figure 28:
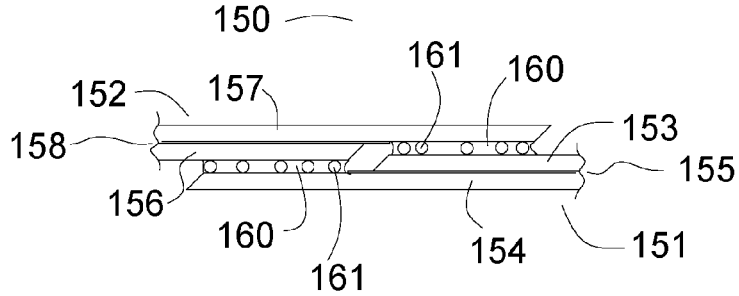
FIG. 28 shows that the stampings of a laminated primary winding preferable have chamfered leading edges in the direction of engagement, and that the solder may have therein small balls of copper, for spacing.

FIG. 28 shows a section through a small portion of the complementary stepped contacts of a laminated primary winding 150 of this invention. A first laminated subassembly 151 may comprise metal stampings 153 and 154 separated by an insulator 155. A second laminated sub-assembly 152 may comprise metal stampings 156 and 157 separated by an insulator 158. Note that the metal stampings 153 to 157 have chamfered leading edges in the direction of engagement, to ensure that they can slide past each other when inserted into the matrix transformer elements and possible insulating sleeve without hanging up even if it is a tight fit.

The first and second laminated sub-assemblies 151 and 152 may be mated and reflow soldered under a clamping pressure. A problem with soldering flat surfaces under a clamping pressure is that the clamping pressure tends to squeeze the solder out of the joint which may compromise the joint and which may also cause other problems as excess solder flows where it should not. It is not the best solution simply to use much less solder, as it may be insufficient to make a good joint.

In FIG. 28, the solder 160—160 in the joints contains a plurality of small balls 161—161, preferably of a material such as copper that is conductive and easily wetted by the solder 160—160. These small balls 161—161 space the metal stampings 153, 154, 156 and 157 apart so that the solder 160—160 cannot be squeezed out, and so that the volume of the contact is known and fixed as the area of the contact times the diameter of the small balls. Accordingly, a metered portion of solder can be used, and it will be known to be just the correct volume.

Because transformers are reciprocal devices, a recitation in the specification or the claims of "primary" or "secondary" are for convenience, and they include transformers which may be connected differently or in reverse.

The teachings of this invention can be used with a single core transformer, and would be particularly useful for making a transformer with a gap-less magnetic core for reduced reluctance in the magnetic circuit. Accordingly, although a matrix transformer usually has a plurality of elements, when a "matrix transformer" is recited in this specification and the claims, it includes a transformer having a single element or core.

A "sheet metal winding" is a winding fabricated of flat stock or thin bar stock, preferably copper, suitable for stacking or nesting to make a laminated primary winding. It may be fabricated by cutting from a coil, forming, stamping, etching, plating or other means. A "sheet insulation" is a thin layer of insulating material for electrically isolating one layer of a laminated primary winding from the other layers. It may comprise an insulator cut from a coil, stamped from a sheet, die cut, molded, extruded, pressed or other means, and it may be an insulating film or coating that is applied by painting, spraying, dipping, vacuum deposition, wrapping or other means. It may have a free shape, or it may acquire a shape, for example a "U" shape, by virtue of being a coating or film on a sheet metal winding having the recited shape.

The invention claimed is:

1. A laminated primary winding for a matrix transformer comprising a plurality of "U" shaped sheet metal windings, a plurality of "U" shaped sheet insulators, the plurality of "U" shaped sheet metal windings being assembled in layers alternately with the plurality of "U" shaped sheet insulators so that each one of the plurality of "U" shaped sheet metal windings is electrically isolated from all of the remainder of the plurality of "U" shaped sheet metal windings, the ends of the plurality of "U" shaped sheet metal windings extending from the laminated primary winding as stepped terminations that are successively stepped so that each one of the plurality of "U" shaped sheet metal windings has an exposed surface electrical contact area for making electrical interconnections within the matrix transformer and for making electrical connections to circuitry that is external to the matrix transformer.

2. The laminated primary winding of claim 1 wherein the "U" shaped sheet metal windings are flat stacked "U" shaped windings.

3. The laminated primary winding of claim 1 wherein the "U" shaped sheet metal windings are nested "U" shaped windings.

4. The laminated primary winding of claim 1 further comprising at least one element of a matrix transformer through which the laminated primary winding has been installed and wherein the laminated primary has been terminated and interconnected using terminations and interconnections from and between the exposed surface electrical contact areas of the laminated primary winding so as to make a matrix transformer.

5. The laminated primary winding of claim 4 wherein the terminations and interconnections comprise stamped metal terminations and interconnections.

6. A laminated primary winding for a matrix transformer comprising at least first and second laminated subassemblies, the first and second laminated subassemblies each comprising a plurality of "U" shaped sheet metal windings, a plurality of "U" shaped sheet insulators, the plurality of "U" shaped sheet metal windings being assembled in layers alternately with the plurality of "U" shaped sheet insulators so that each one of the plurality of "U" shaped sheet metal windings is electrically isolated from all of the remainder of the plurality of "U" shaped sheet metal windings, the first and second laminated subassemblies further having complementary successively stepped exposed electrical contact areas which can be mated to connect the first laminated subassembly to the second laminated subassembly within the matrix transformer.

7. A laminated primary winding for a matrix transformer comprising a plurality of "U" shaped sheet metal windings, a plurality of "U" shaped sheet insulators, the plurality of "U" shaped sheet metal windings being assembled in layers alternately with the plurality of "U" shaped sheet insulators so that each one of the plurality of "U" shaped sheet metal windings is electrically isolated from all of the remainder of the plurality of "U" shaped sheet metal windings, the ends of the plurality of "U" shaped sheet metal windings extending from the laminated primary winding as stepped terminations that are successively stepped so that each one of the plurality of "U" shaped sheet metal windings has an exposed surface electrical contact area for making electrical interconnections within the matrix transformer and for making electrical connections to circuitry that is external to the matrix transformer, and at least one element of a matrix transformer through which the laminated primary winding has been installed and wherein the laminated primary has been terminated and interconnected using terminations and interconnections from and between the exposed surface electrical contact areas of the laminated primary winding so as to make a matrix transformer.

8. The laminated primary winding of claim 7 wherein the terminations and interconnections comprise stamped metal terminations and interconnections.

* * * * *